US006563259B2

(12) United States Patent
Lim

(10) Patent No.: US 6,563,259 B2
(45) Date of Patent: May 13, 2003

(54) DEFLECTION YOKE OF BRAUN TUBE AND METHOD FOR FABRICATING AUXILIARY COIL OF DEFLECTION YOKE

(75) Inventor: Jong Ho Lim, Daegu (KR)

(73) Assignee: LG Electronics Inc., Seoul (KR)

( * ) Notice: Subject to any disclaimer, the term of this patent is extended or adjusted under 35 U.S.C. 154(b) by 71 days.

(21) Appl. No.: 09/749,416

(22) Filed: Dec. 28, 2000

(65) Prior Publication Data

US 2001/0006323 A1 Jul. 5, 2001

(30) Foreign Application Priority Data

Dec. 30, 1999 (KR) ..... 1999/66371

(51) Int. Cl.[7] ..... H01J 29/70; H01J 29/76
(52) U.S. Cl. ..... 313/440; 313/431
(58) Field of Search ..... 313/440, 431, 313/432, 413, 433, 426, 428; 335/211, 212, 213, 210

(56) References Cited

U.S. PATENT DOCUMENTS

| | | | | | |
|---|---|---|---|---|---|
| 4,034,324 | A | * | 7/1977 | Sano et al. | 335/210 |
| 4,246,560 | A | * | 1/1981 | Shimizu et al. | 335/210 |
| 5,864,204 | A | * | 1/1999 | Ihm | 313/413 |
| 6,160,343 | A | * | 12/2000 | Joung | 313/430 |
| 6,380,667 | B1 | * | 4/2002 | Yokota et al. | 313/431 |
| 2001/0040426 | A1 | * | 11/2001 | Kim | 313/440 |

* cited by examiner

*Primary Examiner*—Haissa Philogene
*Assistant Examiner*—Chuc D Tran
(74) *Attorney, Agent, or Firm*—Fleshner & Kim, LLP

(57) ABSTRACT

A deflection yoke of Braun tube having a horizontal deflection coil for horizontally deflecting electron beams radiated from an electron gun, a vertical deflection coil for vertically deflecting the electron beams, and a holder inserted between the horizontal and the vertical deflection coils for mechanically fixing them and electrically insulating them, including: an auxiliary coil having a first deflection portion coil extendedly formed from a '3-o'clock' position of a neck side to a '3-o'clock' direction of a screen side on the basis of the lengthy direction of the deflection coil; a first flange coil extendedly formed for a predetermined length from a '3-o'clock' position of the screen side to a '12-o'clock' direction of the screen side; a second deflection portion coil extendedly formed for a predetermined length from a '12-o'clock' position of the screen side to a '12-o'clock' direction of the neck side; a second flange coil extendedly formed for a predetermined length from a '12-o'clock' position of the neck side to a '9-o'clock' direction of the neck side; a third deflection portion coil extendedly formed for a predetermined length from a '9-o'clock' position of the neck side to a '9-o'clock' direction of the screen side; a third flange coil extendedly formed from a '9-o'clock' position of the screen side to a '6-o'clock' direction of the screen side; a fourth deflection portion coil extendedly formed for a predetermined length from a '6-o'clock' position of the screen side to a '6-o'clock' direction of the neck side; and a fourth flange coil extendedly formed from a '6-o'clock' position of the neck side to a '3-o'clock' direction of the neck side. Accordingly, misconvergence of a deflection yoke of Braun tube can be complemented without using an additional circuit and power consumption is reduced.

17 Claims, 6 Drawing Sheets

DEFLECTION YOKE OF BRAUN TUBE AND METHOD FOR FABRICATING AUXILIARY COIL OF DEFLECTION YOKE

BACKGROUND OF THE INVENTION

1. Field of the Invention

The present invention relates to a deflection yoke (DY) of Braun tube, and more particularly, to a deflection yoke of Braun tube having an auxiliary coil which is capable of preventing a back electromotive force according to a main magnetic field even though the auxiliary coil is disposed at a portion where a main coil of a deflection yoke is disposed, to thereby complement characteristics of the main coil, and a method for fabricating an auxiliary coil of the deflection yoke.

2. Description of the Background Art

FIG. 1 shows a side view of a general Braun tube in accordance with a conventional art.

As shown in the drawing, Braun tube 1 includes a screen 3 on which an electron beam 10 radiated from an electron gun 2 is reproduced as a picture, and a deflection yoke 20 for deflecting the electron beam 10 coming from the electron gun 2 onto a corresponding fluorescent surface of the screen 3.

FIG. 2A is a side view of a saddle-saddle type deflection yoke and FIG. 2B is a plan view of the saddle-saddle type deflection yoke viewed from its opening side.

As shown in FIG. 2A, the saddle-saddle type deflection yoke 20 for Braun tube includes a horizontal deflection coil 21 for horizontal deflection, a vertical deflection coil 22 for vertical deflection, a ferrite core 23 for complementing a magnetic force generated by the current flowing to the horizontal deflection coil 21 and the vertical deflection coil 22 and improving a deflection efficiency; a holder 24 for mechanically determining relative positions of the horizontal deflection coil 21, the vertical deflection coil 22 and the ferrite core 23 and mechanically fixing and combining them; a convergence yoke (or, called comma-free coil) typically disposed at a neck portion 29 of the holder 24 for improving a comma aberration generated by a vertical barrel type magnetic field; a ring band 26 disposed at the end of the neck portion of the holder 24 for mechanically combining the Braun tube 1 and the deflection yoke 20; and a magnet 27 typically disposed at the end of an opening 28 of the deflection yoke 20 for correcting a raster distortion appearing at the upper end portion and a lower end portion of the screen.

Thusly constructed deflection yoke 20 of the Braun tube generates a deflection magnetic field as current having a predetermined wave form is applied to the horizontal deflection coil 21 and the vertical deflection coil 22. In this respect, generally, the distribution of each deflection coil is adjusted in the lengthy direction, so that the red, green and blue electron beams 10 starting from different points can be converged to the same point on the screen and the outermost angle raster form (refer to reference numeral 61 of FIG. 8) can make a straight line with a predetermined size.

A signal in synchronization with the horizontal and vertical deflection current may flow to the convergence yoke 25, so as to complement characteristics that is not enough to complete convergence by merely adjusting the distribution in the lengthy direction of the horizontal deflection coil 21 and the vertical deflection coil 22.

Failure of converging the red, green and blue electron beams 10 to one point on the screen is called misconvergence (refer to reference numeral 62 of FIG. 8). Conventionally, the misconvergence has been complemented in a manner that a convergence yoke 25 is usually installed at the neck portion 29 of the deflection yoke, the starting point of the electron beams 10 to thereby complement the initial position.

However, such method is limitedly adopted due to the following technical limitations.

First, in case of using the horizontal deflection current, the inductance is not possibly generated by above a predetermined level only with the use of the convergence yoke 25, so that it is not applicable to a high frequency-adopted Braun tube. Thus, due to the limitation factor that the inductance is to be generated by below a predetermined level, its application is not easy in general cases where an additional circuit is not employed.

Secondly, in case of using the convergence yoke 25, the length of a magnetic pole in use for the convergence yoke 25 is to be adjusted to the length limited in a neck portion. Thus, in order to have an effect at a favorable level, the number of turns of a coil should be increased to set an inductance value very high. However, due to the limitation to the space, winding of coil is limited, and thus, it is very difficult to lower a resistance. Accordingly, in case of using the vertical deflection current, there is a limitation for application.

Thirdly, as shown in FIGS. 5A and 5B, a ferrite core winding auxiliary coil 65 is installed at the position of the main deflection coil, not at the position of the convergence yoke 25. In this case, however, the auxiliary coil 65 interacts with the magnetic field mostly formed by the horizontal deflection coil 21, so that if a protective circuit is not provided therefor, the horizontal deflection magnetic field is much damaged, causing a difficulty in implementing a desired characteristic. In addition its application incurs much expense.

SUMMARY OF THE INVENTION

Therefore, an object of the present invention is to provide a deflection yoke of Braun tube having an auxiliary coil which are capable of complementing misconvergence of a deflection yoke of Braun tube without using an additional circuit and capable of reducing power consumption.

To achieve these and other advantages and in accordance with the purpose of the present invention, as embodied and broadly described herein, there is provided a deflection yoke of Braun tube having a horizontal deflection coil for horizontally deflecting electron beams radiated from an electron gun, a vertical deflection coil for vertically deflecting the electron beams, and a holder inserted between the horizontal and the vertical deflection coils for mechanically fixing them and electrically insulating them, including: an auxiliary coil having a first deflection portion coil extendedly formed from a '3-o'clock' position at a neck side to a '3-o'clock' direction of a screen side on the basis of the lengthy direction of the deflection coil; a first flange coil extendedly formed for a predetermined length from a '3-o'clock' position at the screen side to a '12-o'clock' direction of the screen side; a second deflection portion coil extendedly formed for a predetermined length from a '12-o'clock' position at the screen side to a '12-o'clock' direction of the neck side; a second flange coil extendedly formed for a predetermined length from a '12-o'clock' position at the neck side to a '9-o'clock' direction of the neck side; a third deflection portion coil extendedly formed for a predetermined length from a '9-o'clock' position at the neck side to a '9-o'clock' direction of the screen side; a third flange coil extendedly formed from a '9-o'clock' position at the screen side to a '6-o'clock' direction of the screen side; a fourth deflection portion coil extendedly formed for a predetermined length from a '6-o'clock' position at the screen side to a '6-o'clock' direction of the neck side; and a fourth flange coil extendedly formed from a '6-o'clock' position at the neck side to a '3-o'clock' direction of the neck side.

The auxiliary coil of the deflection yoke of Braun tube of the present invention is preferably installed at the holder of the deflection yoke.

The auxiliary coil of the deflection yoke of Braun tube of the present invention is preferably installed at a neck side of the deflection yoke.

To the auxiliary coil of the deflection yoke of Braun tube of the present invention, current in synchronization with a vertical deflection current is preferably applied.

To the auxiliary coil of the deflection yoke of Braun tube of the present invention, current in synchronization with a horizontal deflection current is preferably applied.

To the auxiliary coil of the deflection yoke of Braun tube of the present invention, current in synchronization with a horizontal deflection current and a vertical deflection current is preferably applied.

The auxiliary coil of the deflection yoke of Braun tube of the present invention is preferably installed at a neck portion of Braun tube.

In order to achieve the above objects, there is also provided a method for fabricating an auxiliary coil of a deflection yoke of Braun tube having a horizontal deflection coil for horizontally deflecting electron beams radiated from an electron gun, a vertical deflection coil for vertically deflecting the electron beams, a holder inserted between the horizontal and the vertical deflection coils for mechanically fixing them and electrically insulating them, and an auxiliary coil installed between the horizontal and the vertical deflection coils to complement misconvergence, including the steps of: fabricating an auxiliary coil having a first deflection portion coil extendedly formed from a '3-o'clock' position at a neck side to a '3-o'clock' direction of a screen side on the basis of the lengthy direction of the deflection coil; fabricating a first flange coil extendedly formed for a predetermined length from a '3-o'clock' position at the screen side to a '12-o'clock' direction of the screen side; fabricating a second deflection portion coil extendedly formed for a predetermined length from a '12-o'clock' position at the screen side to a '12-o'clock' direction of the neck side; fabricating a second flange coil extendedly formed for a predetermined length from a '12-o'clock' position at the neck side to a '9-o'clock' direction of the neck side; fabricating a third deflection portion coil extendedly formed for a predetermined length from a '9-o'clock' position at the neck side to a '9-o'clock' direction of the screen side; fabricating a third flange coil extendedly formed from a '9-o'clock' position at the screen side to a '6-o'clock' direction of the screen side; fabricating a fourth deflection portion coil extendedly formed for a predetermined length from a '6-o'clock' position at the screen side to a '6-o'clock' direction of the neck side; and fabricating a fourth flange coil extendedly formed from a '6-o'clock' position at the neck side to a '3-o'clock' direction of the neck side.

In the method for fabricating an auxiliary coil of a deflection yoke in accordance with the present invention, it is preferred that the auxiliary coil is formed having the same length as that of the vertical deflection coil according to a pattern of misconvergence.

In the method for fabricating an auxiliary coil of a deflection yoke in accordance with the present invention, it is preferred that the auxiliary coil is formed having the same length as that of the horizontal deflection coil according to a pattern of misconvergence.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
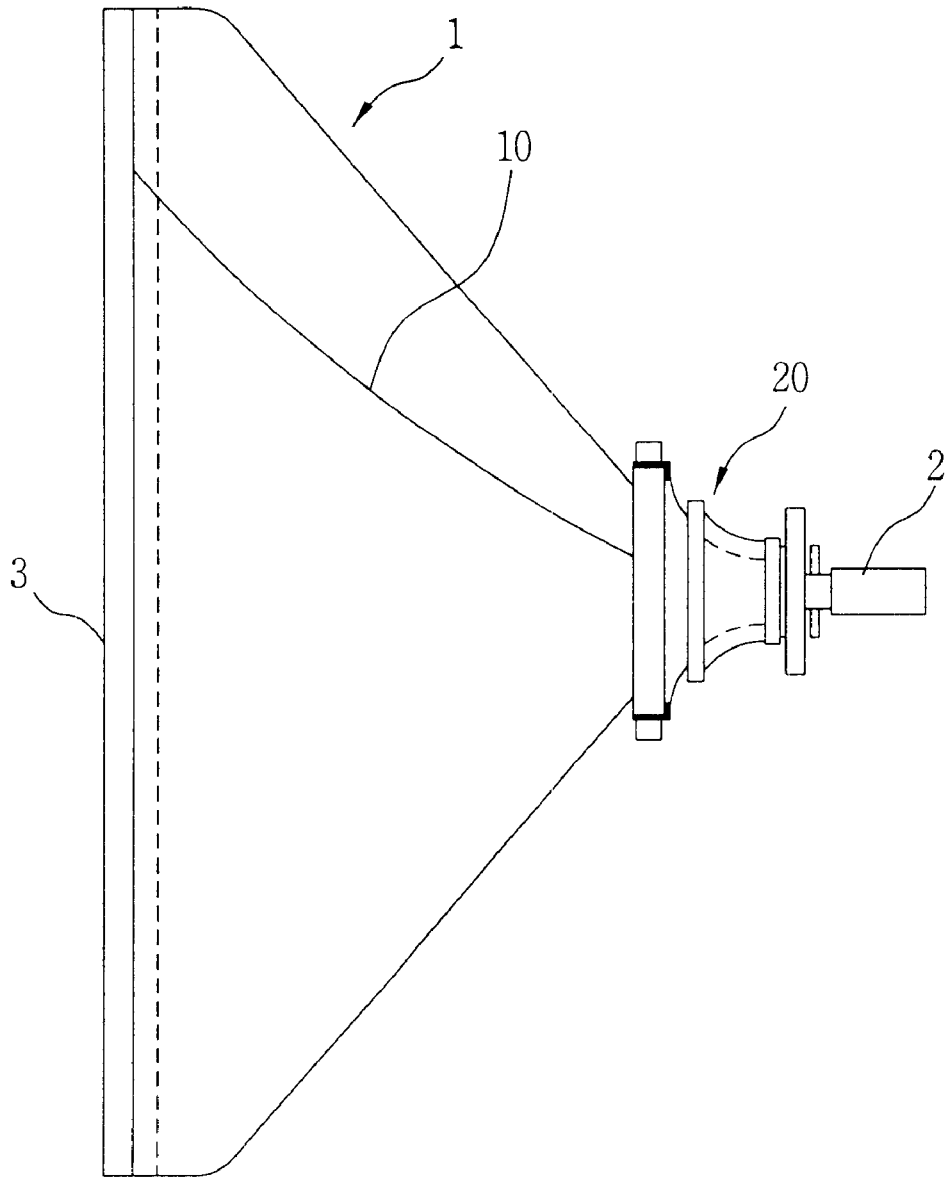
FIG. 1 CONVENTIONAL ART
FIG. 1 is a side view of a general Braun tube in accordance with a conventional art.

Reference will now be made in detail to the preferred embodiments of the present invention, examples of which are illustrated in the accompanying drawings.

An auxiliary coil 50 of a deflection yoke 20 of the present invention is installed at an outer surface of holders 24 and 34 where main deflection coils, that is, horizontal deflection coils 21 and 31 and vertical deflection coils 22 and 32 are disposed, rather than being disposed at an outer portion of a convergence yoke 25.

Figure 2A:
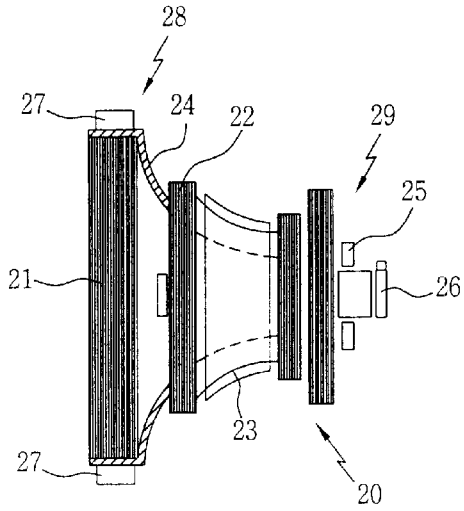
FIG. 2A CONVENTIONAL ART
FIG. 2A is a side view of a saddle-saddle type deflection yoke.
Figure 2B:
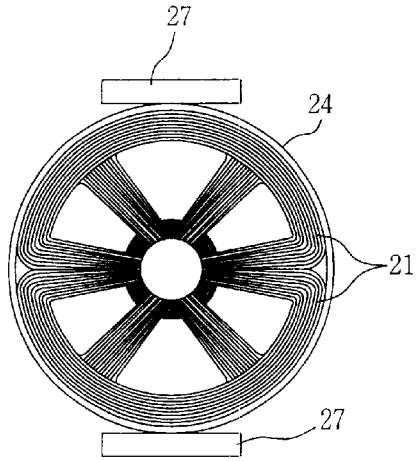
FIG. 2B CONVENTIONAL ART
FIG. 2B is a plan view of the saddle-saddle type deflection yoke viewed from an opening side.
Figure 3:
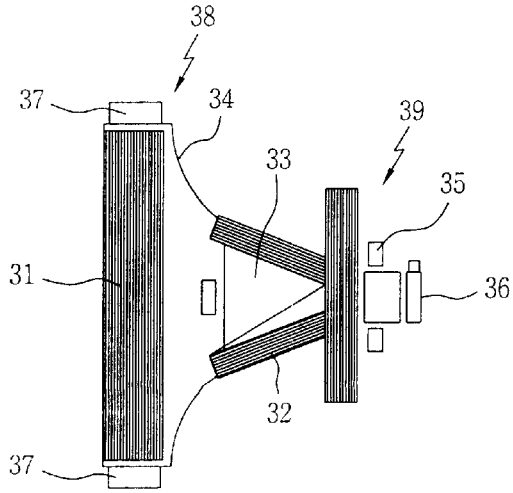
FIG. 3 CONVENTIONAL ART
FIG. 3 is a side view of a saddle-toroidal type deflection yoke.
Figure 4A:
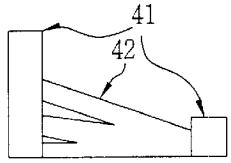
FIG. 4A CONVENTIONAL ART
FIG. 4A is a side view of a general coil.
Figure 4B:
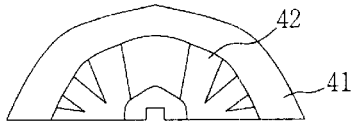
FIG. 4B CONVENTIONAL ART
FIG. 4B is a plan view of the general coil.
Figure 4C:
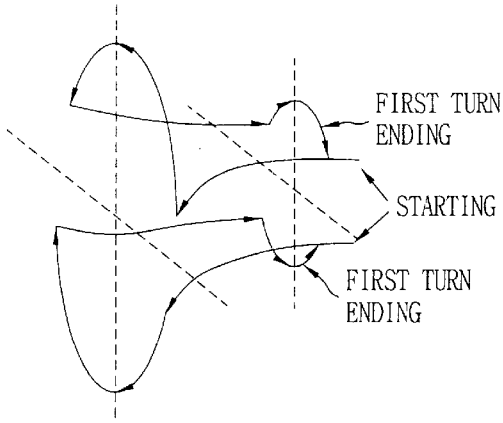
FIG. 4C CONVENTIONAL ART
FIG. 4C illustrates winding method of the general coil in accordance with the conventional art.
Figure 5A:
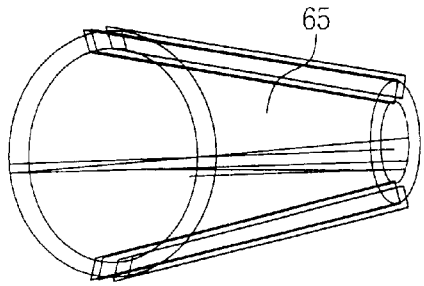
FIG. 5A CONVENTIONAL ART
FIGS. 5A and 5B are exemplary view showing application of a 4-pole auxiliary coil of a general ferrite core-winding method.
Figure 5B:
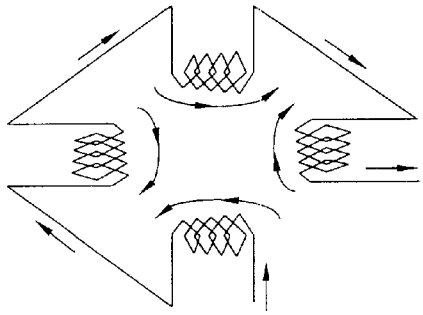
FIG. 5B CONVENTIONAL ART

FIG. 2A is a side view of a saddle-saddle type deflection yoke.

Figure 6A:
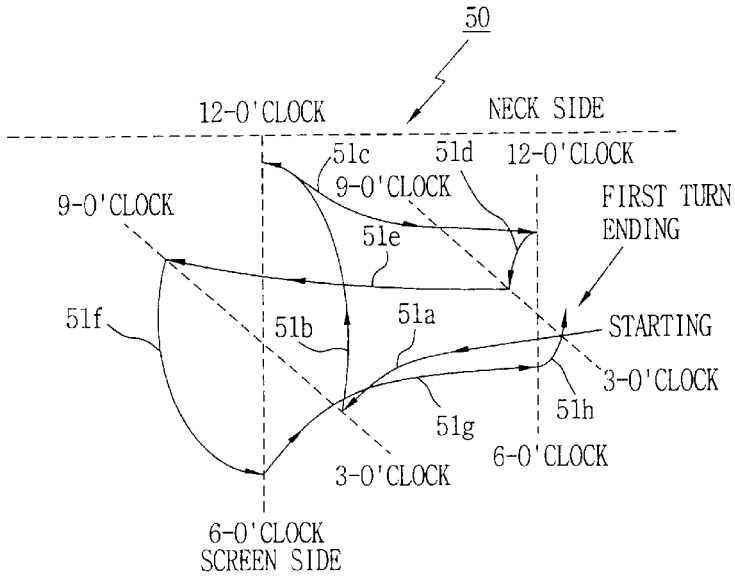
FIG. 6A illustrates winding method of an auxiliary coil in accordance with the present invention.

As shown in the drawing, the auxiliary coil 50 as shown in FIG. 6*a* is installed at the outer surface of the holder 24 at which the vertical deflection coil 22 is disposed. The auxiliary coil 50 generates a magnetic field in a quadrupole, not in a form of a closed loop.

That is, on the basis of the lengthy direction of the deflection coils 21 and 22, as shown in FIG. 6A, a first deflection portion coil 51*a* is formed in a '3-o'clock' direction at the neck side, and a first flange coil 51*b* is formed from a '3-o'clock' position to a '12-o'clock' position at the screen side. And then, a second deflection portion coil 51*c* is formed from a '12-o'clock' position at the screen side to the neck side, and a second flange coil 51*d* is formed from a '12-o'clock' position to a '9-o'clock' position at the neck side. And then, a third deflection portion coil 51*e* is formed from a '9-o'clock' position at the neck side to a '9-o'clock' position at the screen side, and a third flange coil 51*f* is formed from a '9-o'clock' position to a '6-o'clock' position at the screen side. And then, a fourth deflection portion coil 51*g* is formed from a '6-o'clock' position at the screen side to a '6-o'clock' position at the neck side, and a fourth flange coil 51*h* is formed from a '6-o'clock' position to a '3-o'clock' position at the neck side. This forming operation is repeatedly performed as much as required.

Figure 7:
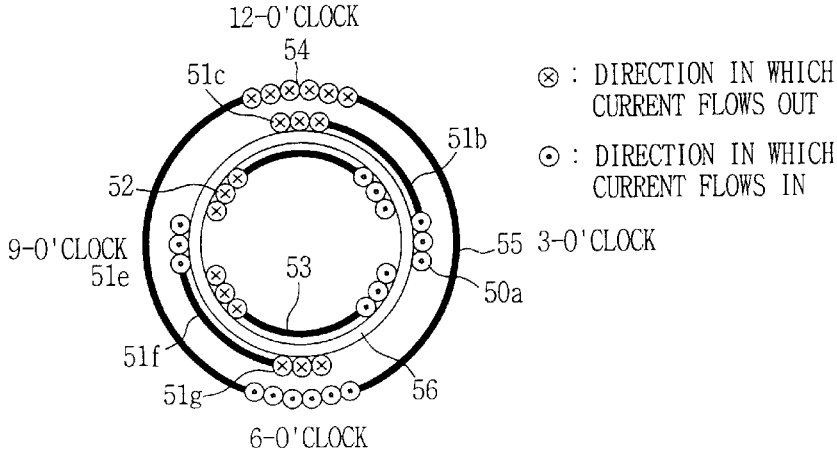
FIG. 7 illustrates a coil section and a flange configuration viewed from a screen side of a saddle-saddle type coil in case that the auxiliary coil is installed in accordance with the present invention.
Figure 8:
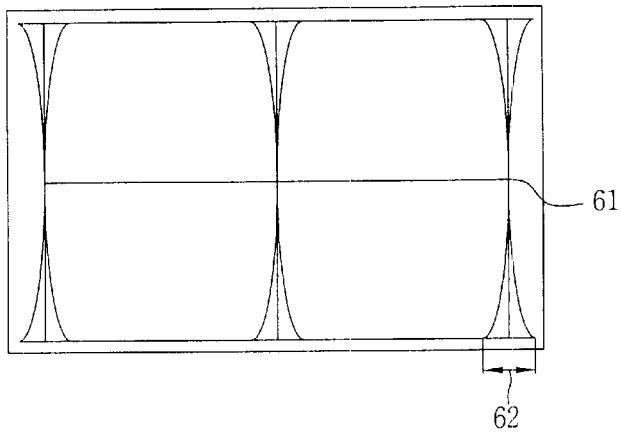
FIG. 8 shows an example of a raster and misconvergence on a screen.
Figure 9:
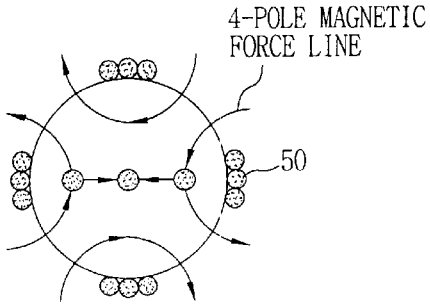
FIG. 9 is a view showing formation of four-pole magnetic force lines by conductivity of the auxiliary coil of the screen and misconvergence correction in accordance with the present invention.

In case where the auxiliary coil 50 formed as described above is installed, a coil section and a flange configuration viewed at the screen side of a saddle-saddle type coil are as shown in FIG. 7.

With reference to FIG. 7, there are shown indications of current that flows in and out, which may indicated a direction to which a coil is wound. Reference numeral 52 denotes a horizontal deflection coil, 53 denotes a horizontal deflection coil flange, 54 denotes a vertical deflection coil, 55 denotes a vertical deflection coil flange, and 56 denotes a holder.

As mentioned above, the auxiliary coil 50 illustrated in FIGS. 6A and 7 is installed at the outer surface of the holder 56, that is, at the space between the horizontal deflection coil and the vertical deflection coil. Or, the auxiliary coil 50 may be installed at the read side of the electron gun 2 of the horizontal deflection coil 21 of the deflection yoke, that is, at the neck portion of the deflection yoke.

Figure 6B:
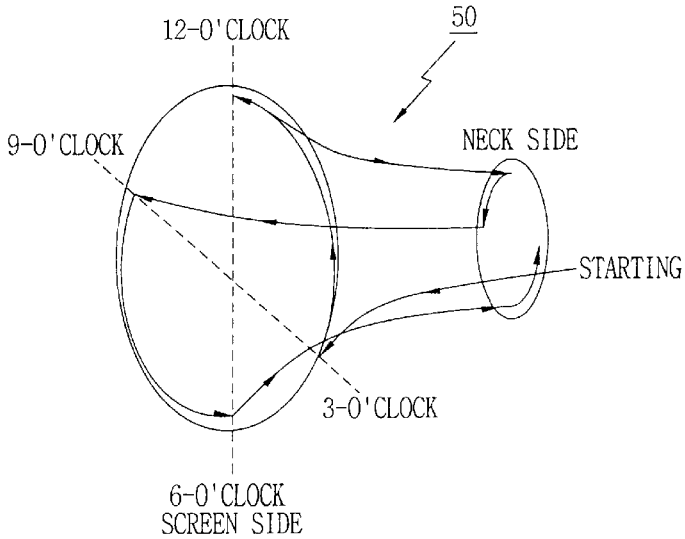
FIG. 6B illustrates auxiliary coil winding state when the auxiliary coil is adopted to a deflection yoke in accordance with the present invention.

The configuration of the auxiliary coil 50 will now be described in detail with reference to FIGS. 6A, 6B and FIG. 7.

The deflection portion coils, that is, the first to the fourth deflection portion coils 51*a*, 51*c*, 51*e* and 51*g* are formed in the axial direction of Braun tube, and flange coils, that is, the firth to the fourth flange coils 51*b*, 51*d*, 51*f* and 51*h* are formed at the end portion of the deflection portion coils. At the other region of an angle at which at least one part of flange coils 51*b* and 51*f* (or 51*d* and 51*h*), another part of flange coils 51*d* and 51*h* (or 51*b* and 51*f*) is formed. The flange coil is alternately formed at the front side and the back side, and the region occupied by each flange coil is formed within 90 degree.

A direction of current flowing from the thusly formed auxiliary coil to the deflection portion coils has the same as that of the deflection portion coil (that is, 51*a* and 51*b*, or 51*c* and 51*g*) positioned at a distance of 180°, while having the opposite current direction as that of the deflection portion coils (that is, 51*a* and 51*c*, or 51*e* and 51*g*) positioned at a distance of 90°.

With reference to FIG. 7, the auxiliary coil is mounted on the outer surface of the holder 24 where the vertical deflection coil 22 is installed, on which the vertical deflection coil is positioned. And, the horizontal deflection coil 21 is installed at the inner surface of the holder 24, and other parts are assembled in the same manner as that of the conventional art.

After assembling, a vertical deflection current or a horizontal deflection current is supplementarily applied to the auxiliary coil 40 as required to complement misconvergence by virtue of the quadrupole working.

The operation of the present invention will now be described.

Unlike the conventional deflection yoke neck portion mounting method in which the convergence yoke 25 is used for correcting misconvergence, the deflection yoke of the present invention is featured in that, as a basic concept, the auxiliary coil is positioned similar to the position of the main deflection coils, so that an effect by virtue of the auxiliary coil 50 can be made through overall range, not partially.

The operation state of the deflection yoke will now be described with reference to FIGS. 6A through 9.

For example, in case that a signal in synchronization with the vertical deflection current is applied to the auxiliary coil 50, a quadrupole, that is, 4-pole magnetic field, is generated in the lengthy direction of the vertical or the horizontal deflection coil.

The 4-pole magnetic field generated by the auxiliary coil varies the positions of the red and blue electron beams, the outer angle electron beam 10, as the in-line type electron beam 10 makes a movement in a free space, which obtains an effect that the red and blue beams are distanced away from each other or come close to each other.

By taking advantage of the effect, in case that a current wave form in synchronization with the vertical deflection current is applied, the distance between the read and the blue electron beams 10 can be adjusted in the horizontal direction of the screen.

In case that a current in synchronization with the vertical deflection current and the horizontal deflection current simultaneously is applied to the auxiliary coil 50, misconvergence of the red and blue electron beams 10 in the horizontal direction of the four corners, that is, the '2-o'clock', '4-o'clock', '8-o'clock' and '10-o'clock' directions on the screen, can be selectively corrected.

Accordingly, the horizontally directional misconvergence due to the main magnetic field caused by the main coils, the vertical deflection coil and the horizontal deflection coil, on the screen can be complemented.

Meanwhile, according to another embodiment of the present invention, the auxiliary coil 50 of the present invention may be formed having the same length as that of the vertical deflection coils 22 and 32 as required, or may be formed having the same length as that of the horizontal deflection coils 21 and 31, which depends on a pattern of misconvergence to be corrected.

As so far described, according to the auxiliary coil formed at the portion where the main coils of the deflection yoke are installed, the following effects can be obtained.

First, since the effect of the auxiliary coil can be made in the long region, misconvergence to be complemented can be minutely adjusted.

Secondly, since back electromotive force due to the mutual inductance does not occur structurally, it is not necessary to install an additional circuit.

Thirdly, it has a structure in which the correction operation can be performed in the long region, the correction sensitivity can be remarkably improved, so that its power consumption for the correction can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. An auxiliary coil for a deflection yoke of a Braun tube having a horizontal deflection coil for horizontally deflecting electron beams radiated from an electron gun, a vertical deflection coil for vertically deflecting the electron beams, and a holder inserted between the horizontal and the vertical deflection coils for mechanically fixing them and electrically insulating them, the auxiliary coil comprising:

a first deflection portion coil extending from a '3-o'clock' position on a neck side of the Braun tube to a '3-o'clock' position on a screen side of the Braun tube relative to a long dimension of the deflection yoke;

a first flange portion extending a predetermined length from the '3-o'clock' position on the screen side to a '12-o'clock' position on the screen side;

a second deflection portion extending a predetermined length from the '12-o'clock' position on the screen side to the '12-o'clock' position on the neck side;

a second flange portion extending a predetermined length from the '12-o'clock' position on the neck side to a '9-o'clock' position on the neck side;

a third deflection portion extending a predetermined length from the '9-o'clock' position on the neck side to a '9-o'clock' position on the screen side;

a third flange portion extending from the '9-o'clock' position on the screen side to a '6-o'clock' position on the screen side;

a fourth deflection portion extending a predetermined length from the '6-o'clock' position on the screen side to a '6-o'clock' position on the neck side; and a fourth flange extending from the '6-o'clock' position on the neck side to a '3-o'clock' position on the neck side.

2. The deflection yoke according to claim 1, wherein the auxiliary coil is installed at the holder of the deflection yoke.

3. The deflection yoke according to claim 1, wherein the auxiliary coil is installed at a neck side of the deflection yoke.

4. The deflection yoke according to claim 1, wherein current in synchronization with a vertical deflection current is applied to the auxiliary coil.

5. The deflection yoke according to claim 1, wherein current in synchronization with a horizontal deflection current is applied to the auxiliary coil.

6. The deflection yoke according to claim 1, wherein current in synchronization with a horizontal deflection current and a vertical deflection current is applied to the auxiliary coil.

7. The deflection yoke according to claim 1, wherein the auxiliary coil is installed at a neck portion of Braun tube.

8. The deflection yoke according to claim 7, wherein current in synchronization with a vertical deflection current is applied to the auxiliary coil.

9. The deflection yoke according to claim 7, wherein current in synchronization with a horizontal deflection current is applied to the auxiliary coil.

10. The deflection yoke according to claim 7, wherein current in synchronization with a horizontal deflection current and a vertical deflection current is applied to the auxiliary coil.

11. A method for fabricating an auxiliary coil of a deflection yoke of a Braun tube having a horizontal deflection coil for horizontally deflecting electron beams radiated from an electron gun, a vertical deflection coil for vertically deflecting the electron beams, a holder inserted between the horizontal and the vertical deflection coils for mechanically fixing them and electrically insulating them, and an auxiliary coil installed between the horizontal and the vertical deflection coils to reduce misconvergence, the method comprising:

forming a from a '3-o'clock' position on a neck side of the Braun tube to a '3-o'clock' position on a screen side of the Braun tube of the deflection yoke;

forming a first flange portion extending a predetermined length from a '3-o'clock' position on the screen side to a '12-o'clock' position on the screen side;

forming a second deflection portion extending a predetermined length from a '12-o'clock' position on the screen side to a '12-o'clock' position on the neck side;

forming a second flange portion extending a predetermined length from a '12-o'clock' position on the neck side to a '9-o'clock' position on the neck side;

forming a third deflection portion extending a predetermined length from a '9-o'clock' position on the neck side to a '9-o'clock' position on the screen side;

forming a third flange portion extending from a '9-o'clock' position on the screen side to a '6-o'clock' position on the screen side;

forming a fourth deflection portion extending a predetermined length from a '6-o'clock' position on the screen side to a '6-o'clock' position on the neck side; and forming a fourth flange portion extending from a '6-o'clock' position on the neck side to a '3-o'clock' position of the neck side.

12. The method according to claim 11, wherein the auxiliary coil is formed to have approximately the same length as that of the vertical deflection coil accordingly to a pattern of misconvergence.

13. The method according to claim 11, wherein the auxiliary coil is formed to have approximately the same length as that of the horizontal deflection coil according to a pattern of misconvergence.

14. An auxiliary coil for a deflection yoke of a Braun tube, comprising:

a single coil comprising multiple winding portions, wherein the multiple winding portions comprise a first flange winding portion at a screen end of the Braun tube and a second flange winding portion at the screen end of the Braun tube, and wherein a current flow in the first flange winding portion is opposite to a current flow in the second flange winding portion.

15. The auxiliary coil of claim 14, further comprising four deflection winding portions, wherein each deflection winding portion runs between a neck end of the Braun tube and a screen end of the Braun tube, and wherein the four deflection winding portions are equally spaced around the Braun tube.

16. The auxiliary coil of claim 15, further comprising a third flange winding portion at a neck end of the Braun tube and a fourth flange winding portion at the neck end of the Braun tube.

17. The auxiliary coil of claim 14, wherein the first flange winding portion and the second flange winding portion define a plane, and wherein the plane is proximate to the screen end of the Braun tube and substantially orthogonal to a length axis of the Braun tube.

* * * * *